US009472908B2

(12) United States Patent
Shendge et al.

(10) Patent No.: US 9,472,908 B2
(45) Date of Patent: Oct. 18, 2016

(54) ELECTRICAL PLUG AND RECEPTACLE ASSEMBLY WITH INTERLOCK MECHANISM

(71) Applicant: Appleton Grp LLC, Rosemont, IL (US)

(72) Inventors: Vilas Subhash Shendge, Pune (IN); Shivlingayya Vishwanath Swami, Pune (IN)

(73) Assignee: Appleton Grp, LLC, Rosemont, IL (US)

( * ) Notice: Subject to any disclaimer, the term of this patent is extended or adjusted under 35 U.S.C. 154(b) by 0 days.

(21) Appl. No.: 14/642,999

(22) Filed: Mar. 10, 2015

(65) Prior Publication Data

US 2016/0156139 A1 Jun. 2, 2016

(51) Int. Cl.

| | |
|---|---|
| ***H01R 13/44*** | (2006.01) |
| ***H01R 13/70*** | (2006.01) |
| ***H01R 13/453*** | (2006.01) |
| ***H01R 13/639*** | (2006.01) |

(52) U.S. Cl.

CPC ..... *H01R 13/701* (2013.01); *H01R 13/4532* (2013.01); *H01R 13/639* (2013.01)

(58) Field of Classification Search

CPC ..... H01R 13/4534; H01R 13/4536; H01R 13/625; H01R 13/6275; H01R 13/707; H01R 33/955; H01R 13/7036; G01R 1/206; H01H 9/104; H01H 9/22; H02B 11/04

USPC ..... 439/137, 138, 314, 332, 333, 335, 338, 439/345; 200/50.01, 50.02, 50.03, 50.11, 200/50.27–50.31, 51.08, 51.09, 51.13

See application file for complete search history.

(56) References Cited

U.S. PATENT DOCUMENTS 4,553,000 A * 11/1985 Appleton ..... H01R 13/629 200/50.29
4,675,479 A * 6/1987 Wallin ..... H01H 9/08 200/51.05

(Continued)

FOREIGN PATENT DOCUMENTS

DE 10 37 549 8/1958
DE 23 42 805 3/1975

(Continued)

OTHER PUBLICATIONS

International Searching Authority, International Search Report and Written Opinion mailed on Feb. 24, 2016, issued in connection with International Application No. PCT/US2015/061003, 15 pages.

*Primary Examiner* — Thanh Tam Le
(74) *Attorney, Agent, or Firm* — McDonnell Boehnen Hulbert & Berghoff LLP.

(57) ABSTRACT

A plug and receptacle assembly including a housing, an actuating mechanism for manipulating a switch to ON and OFF positions, a plug receptacle adapted to receive a plug, a link driving member attached to the actuating mechanism, a link member adapted to move laterally when the switch is moved to the ON position, a link blocking member movable from a position where lateral movement of the link member is blocked to a position where lateral movement of the link member is allowed, wherein upon insertion of the plug into the plug receptacle, a notch on the plug causes the link blocking member to move into the unblocked position where the actuating mechanism is movable to have the link driving member laterally move the link member and to turn the switch from the OFF position to the ON position.

29 Claims, 12 Drawing Sheets

(56) References Cited

U.S. PATENT DOCUMENTS 5,212,624 A 5/1993 Johnson et al.
5,298,701 A 3/1994 Sandor
5,358,429 A 10/1994 Mina
5,631,454 A * 5/1997 Hubacher ..... B60K 37/06 200/296
5,680,926 A * 10/1997 Sandor ..... H01R 13/707 200/50.11
5,741,149 A 4/1998 Anthony
5,880,420 A * 3/1999 Rohmer ..... H01R 13/71 200/50.28
6,040,543 A 3/2000 Mina et al.
6,255,607 B1 * 7/2001 Miller ..... H01R 13/707 200/50.29
6,368,133 B1 * 4/2002 Zeiler ..... H01R 13/625 439/321
6,376,785 B1 * 4/2002 Graninger ..... H01H 13/503 200/329
6,396,009 B1 * 5/2002 Yu ..... H01R 33/9555 200/51 R
6,410,868 B1 * 6/2002 Berlemont ..... H01R 13/707 200/50.28
6,956,176 B2 * 10/2005 Castaldo ..... H01R 13/701 200/50.28
7,537,472 B1 5/2009 Schwarz et al.
8,563,883 B1 * 10/2013 Flegel ..... H02B 1/48 200/50.02

FOREIGN PATENT DOCUMENTS

DE 100 03 047 8/2000
EP 0 632 540 1/1995
EP 1 075 055 2/2001

* cited by examiner

ELECTRICAL PLUG AND RECEPTACLE ASSEMBLY WITH INTERLOCK MECHANISM

BACKGROUND

The present application generally relates to electrical plug and plug receptacle assemblies. More particularly, the present application relates to an electrical plug and plug receptacle assembly having an interlock mechanism that prevents a switch from being turned on unless a plug is positioned in the receptacle and prevents the plug from being removed from the receptacle when the switch is turned to an ON position. The electrical plug and receptacle assembly with an interlock mechanism is useful in hazardous locations, such as National Electric Code (NEC) Class I, Division 1 areas, and may advantageously be used in explosion-proof electrical plug receptacles.

In hazardous locations, such as NEC Class I, Division 1 areas, electrical plugs and receptacles are required to supply electric power to various pieces of equipment and/or machines. Safety is of the utmost importance in such locations due to the presence of high voltage and the presence of combustible material. As a result, it is desirable to provide safety features that prevent a switch within an electrical plug receptacle from being energized unless the electrical plug is positioned in the receptacle, and that prevent the electrical plug from being removed from the electrical plug receptacle when the switch is energized.

In a prior design, a flaw existed such that the switch could be positioned between the ON and OFF positions, wherein the electrical plug could be removed without de-energizing the switch, and the switch could be energized without full engagement of the plug. Therefore, it would also be desirable to provide a switch that is more reliably positioned in either the ON or OFF position.

SUMMARY

In one aspect, an electrical plug and receptacle assembly is provided including a housing having an internal cavity, a switch positioned within the internal cavity of the housing, an actuating mechanism positioned on an exterior of the housing and adapted for manipulating the switch to an ON position and to an OFF position, a plug receptacle attached to the housing, the plug receptacle adapted to receive a plug, a plug having a notch positioned on an outer surface of the plug, the notch having a front side and a rear side, a link driving member positioned within the housing and attached to the actuating mechanism, a link member positioned within the housing, the link member adapted to move laterally when the switch is turned from the OFF position to the ON position, a link blocking member positioned within the housing that is movable from a first blocking position where lateral movement of the link member is blocked to a second unblocked position where lateral movement of the link member is allowed, wherein when the plug is fully inserted into the plug receptacle, the front side of the notch on the plug contacts the link blocking member and causes the link blocking member to move into the second unblocked position, wherein when the link blocking member is in the second unblocked position with the plug fully inserted into the plug receptacle, the actuating mechanism is movable to have the link driving member laterally move the link member and turn the switch from the OFF position to the ON position.

The electrical plug and receptacle assembly may further optionally be provided wherein upon lateral movement of the link member when the switch is turned to the ON position, a notch blocking member is moved into position behind the rear side of the notch on the plug that prevents removal of the plug when the switch is turned to the ON position.

In a further aspect, an electrical plug and receptacle assembly is provided including a housing having an internal cavity, a switch positioned within the internal cavity of the housing, an actuating mechanism positioned on an exterior of the housing and adapted for manipulating the switch to an ON position and to an OFF position, a plug receptacle attached to the housing, the plug receptacle adapted to receive a plug, means for preventing movement of the actuating mechanism to manipulate the switch to an ON position when the plug is not positioned in the plug receptacle, and means for preventing removal of the plug from the plug receptacle when the switch is in the ON position.

In another aspect, a method of providing an interlocking mechanism for an electrical plug and receptacle is provided, including the steps of: (1) providing an electrical plug and receptacle assembly having a housing with an internal cavity, a switch positioned within the internal cavity of the housing, an actuating mechanism positioned on an exterior of the housing and adapted for manipulating the switch to an ON position and to an OFF position, a plug receptacle attached to the housing, the plug receptacle adapted to receive a plug, a plug having a notch positioned on an outer surface of the plug, the notch having a front side and a rear side, a link driving member positioned within the housing and attached to the actuating mechanism, a link member positioned within the housing, the link member adapted to move laterally when the switch is turned from the OFF position to the ON position, a link blocking member positioned within the housing that is movable from a first blocking position where lateral movement of the link member is blocked to a second unblocked position where lateral movement of the link member is allowed, (2) inserting the plug into the plug receptacle to cause the front side of the notch on the plug to contact the link blocking member and move the link blocking member into the second unblocked position, (3) moving the actuating mechanism to cause the link driving member to laterally move the link member and move a notch blocking member into position behind the rear side of the notch on the plug, and (4) further moving the actuating mechanism to turn the switch from the OFF position to the ON position, wherein the notch blocking member prevents removal of the plug when the switch is turned to the ON position.

BRIEF DESCRIPTION OF THE DRAWINGS

Exemplary embodiments of the invention are described herein with reference to the drawings, wherein like parts are designated by like reference numerals, and wherein.

DETAILED DESCRIPTION

The present embodiments are directed to an electrical plug and receptacle assembly wherein a switch within the plug receptacle housing is incapable of being turned to the ON position unless a plug has been fully inserted into the plug receptacle of the plug receptacle housing, and the plug is incapable of being removed from the plug receptacle when the switch within the plug receptacle housing is in the ON position.

Figure 1:
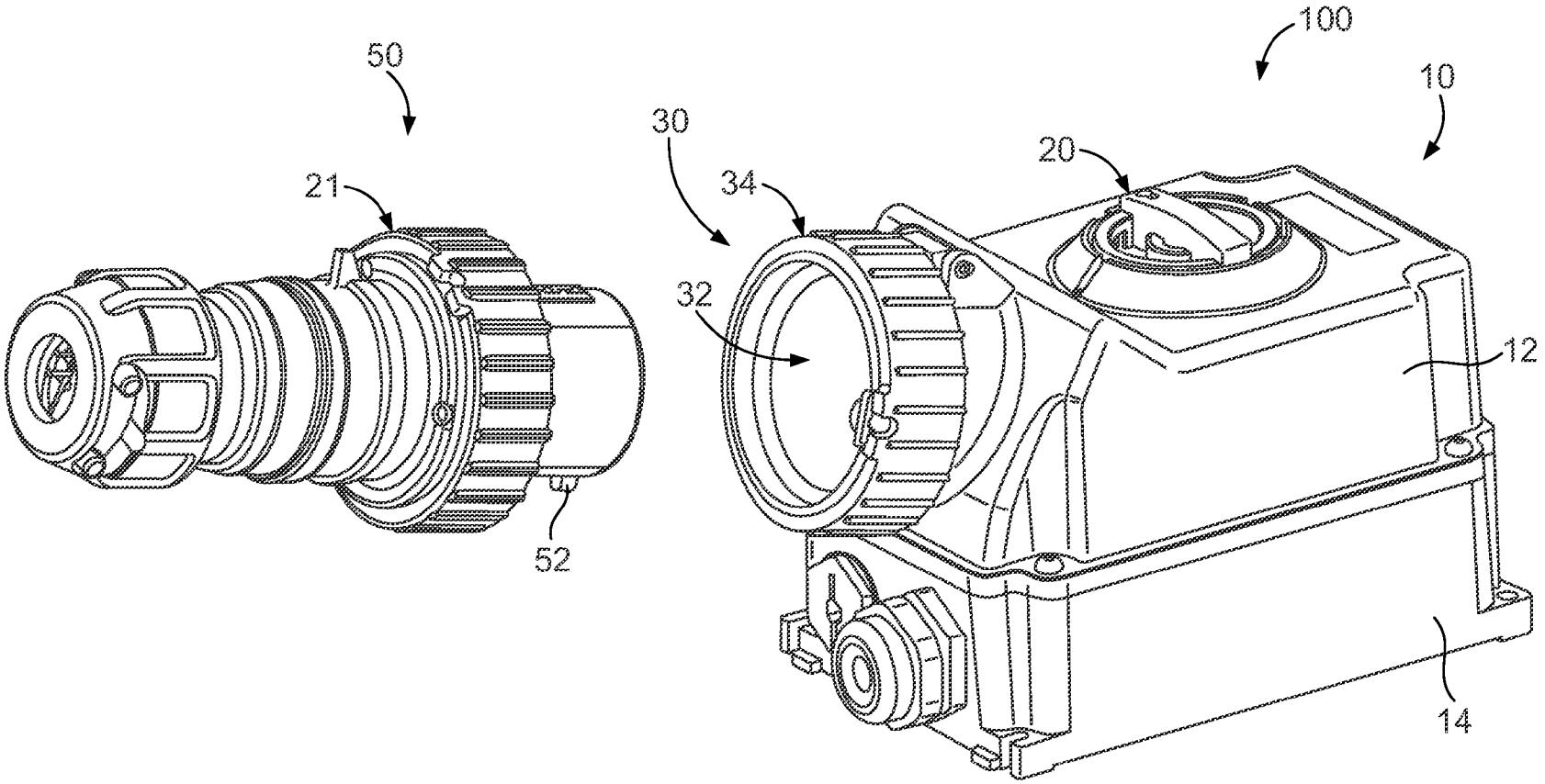
FIG. 1 is a perspective view of plug 50 and plug receptacle housing 10 of electrical plug and receptacle assembly 100, according to an example embodiment.

FIG. 1 is a perspective view of electrical plug 50 and plug receptacle housing 10 of electrical plug and receptacle assembly 100, according to an example embodiment. Electrical plug and receptacle assembly 100 includes a plug receptacle housing 10, that includes an upper housing 12 secured to a lower housing 14. A plug receptacle 30 is secured to the housing and provides a passage to the inside of the housing 10. An actuating mechanism 20 is shown positioned on the exterior of the upper housing 12. Actuating mechanism 20 is operable to manipulate a switch within the housing 10 from an ON position to an OFF position and vice versa.

The plug receptacle 30 includes a cover 34 having a front surface 32 that prevents entry dirt and debris into housing 10, when not in use. Plug receptacle 30 is adapted to receive plug 50 such that an electrical connection is formed when the plug 50 is fully inserted into the plug receptacle 30. Cover 34 may be removed or opened to allow for the entry of plug 50 into plug receptacle 30.

Once plug 50 is inserted into the plug receptacle 30, a threaded rotating member 21 on the plug 50 can be screwed onto corresponding mating threads on the plug receptacle 30 to help secure the plug 50 to the plug receptacle 30. A notch 52 is shown on the outer surface of the plug 52 that, as described in more detail below, is used to unlock the plug receptacle 30 and allow the actuating mechanism 20 to move to manipulate a switch within the housing 10 from an OFF to an ON position.

Figure 2:
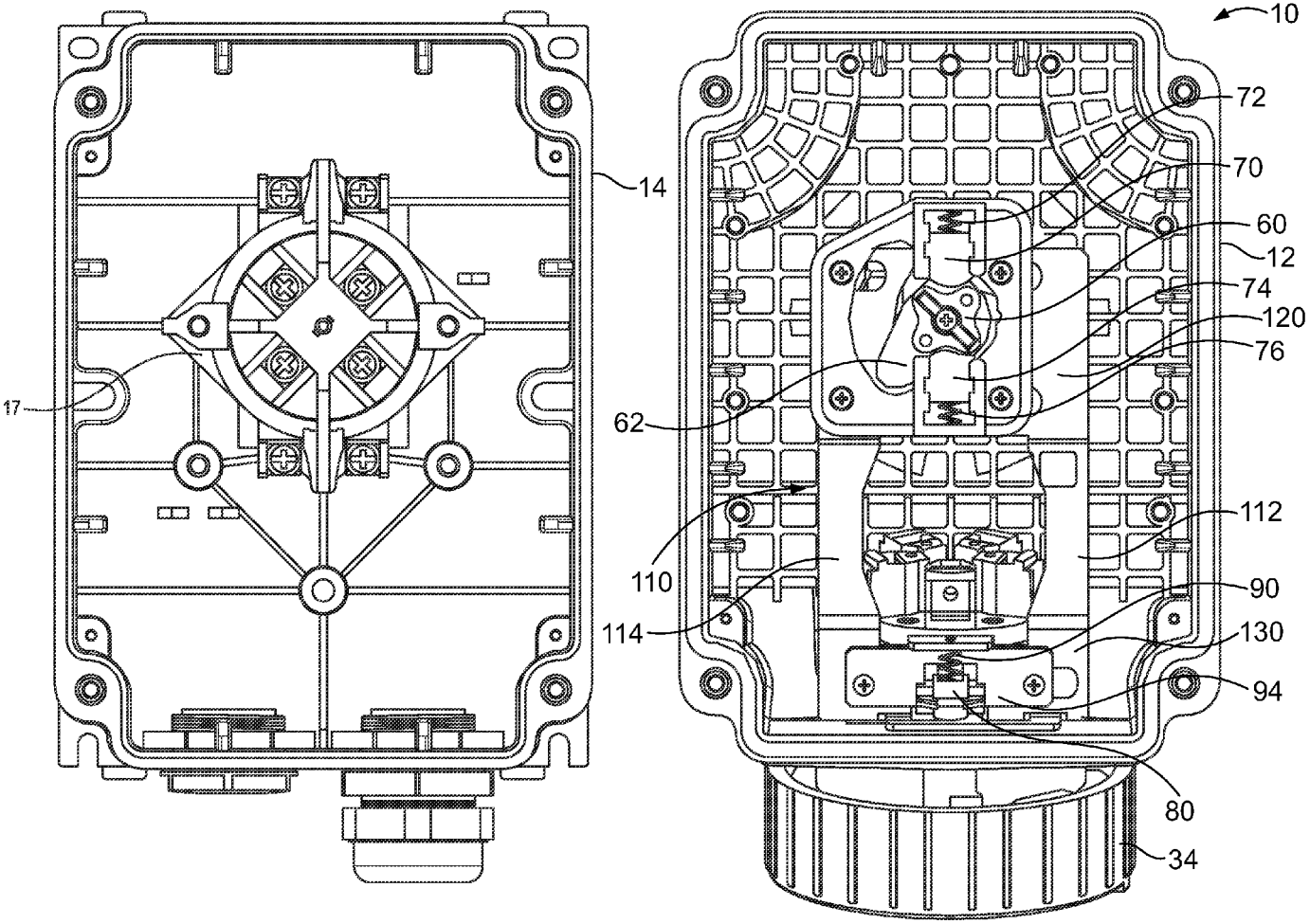
FIG. 2 illustrates views into the inside of upper and lower housings 12, 14 of the plug receptacle housing 10 shown in FIG. 1, according to an example embodiment.

FIG. 2 shows a view into the inside of lower housing 14 and a view from below into the inside of upper housing 12. A switch 17 is shown positioned in lower housing 14. Cover 34 is shown positioned on the upper housing 12 indicating that the switch is positioned in the OFF position. A link driving member 60 is attached to the actuating mechanism 20 (shown in FIG. 1), such that when the plug is inserted into the plug receptacle, upon initial rotation of actuating mechanism 20, the link driving member 60 is caused to rotate which in turn causes link member 110 to move laterally. Upon further rotation of actuating mechanism 20, the switch 17 is caused to be turned to an ON position, and downwardly extending tab 132 (shown in FIG. 3) has been caused to be moved behind the notch 52 on plug 50 such that removal of the plug 50 is prevented when the switch 17 is in the ON position.

When the switch 17 is in the OFF position as shown in FIG. 2, a link blocking member 80 is positioned within an upper portion 130 of the link member 110 and held in place within plate 94 that is secured to the upper housing 12. The link blocking member 80 is biased by spring 90 into a position such that movement of the link member 110 is blocked by the link blocking member 80 when the switch is in the OFF position and the plug is not positioned within the plug receptacle. In this manner, the interaction of the link blocking member 80 and link member 110 together prevent the link driving member 60 from rotating, and in turn prevent the switch 17 from being turned to an ON position when the plug is not inserted into the plug receptacle.

Link driving member 60 includes an extension 62 that contacts the link member 110 when link driving member 60 is rotated. To insure that the link driving member 60 is in either an ON position or an OFF position, the link driving member 60 includes an indexing mechanism that cooperates with a pair of followers 70 and 74 that are biased against link driving member 60 by springs 72 and 76 respectively. The followers 70 and 74 cooperate with complementary outer surfaces of the link driving member 60 that are spaced apart by 90 degrees to advantageously ensure that the link driving member 60 is either fully in the ON position or fully in the OFF position.

Figure 3:
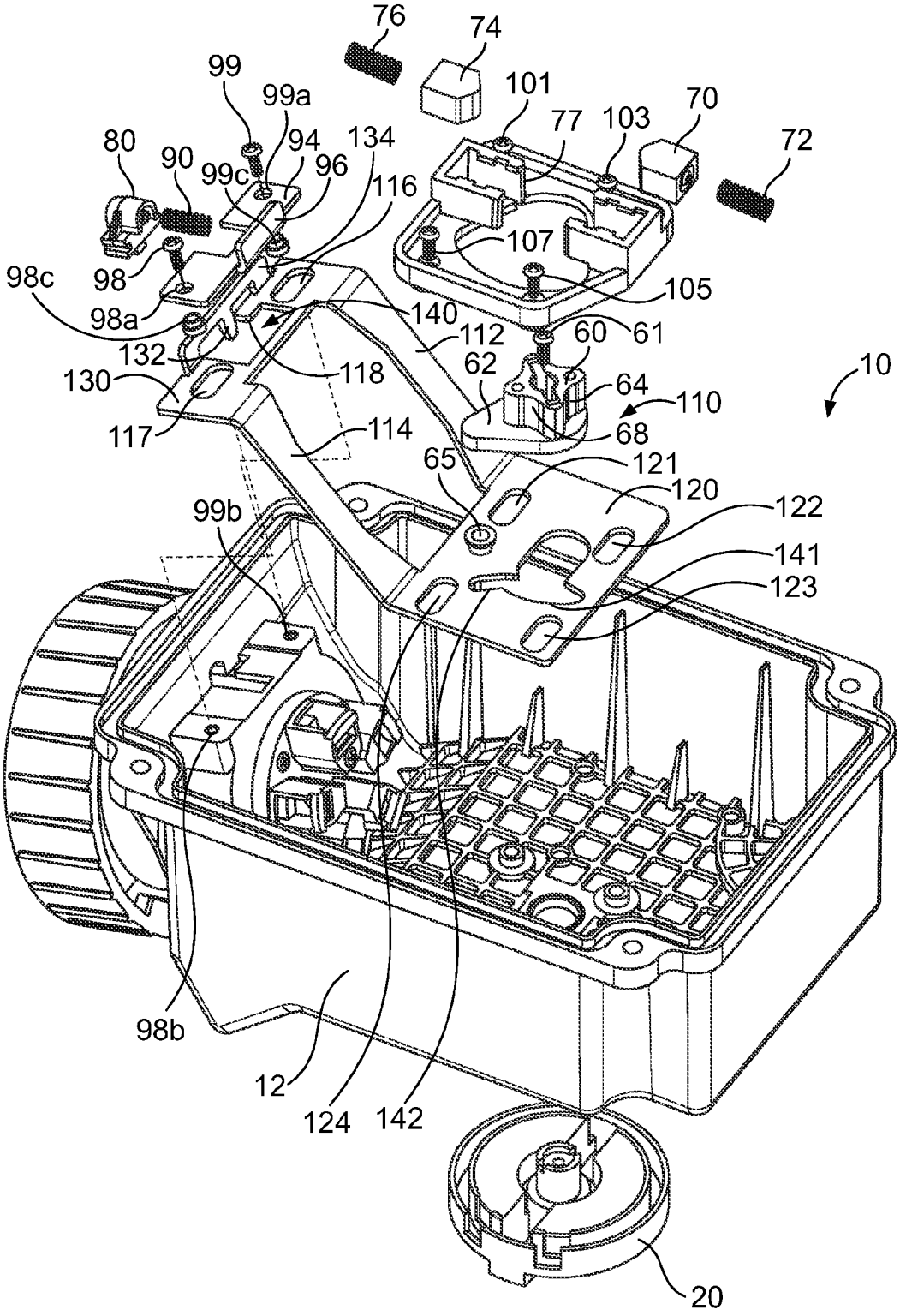
FIG. 3 is an exploded view of the plug receptacle housing 10 shown in FIGS. 1 and 2.

FIG. 3 is an exploded view of the plug receptacle housing 10 shown in FIGS. 1 and 2. Followers 70 and 74 and springs 72 and 76 are positioned within follower holder 77. Link driving member 60 includes detent surfaces 66 and 64 that are complementary with the ends of followers 70 and 74. Link driving member 60 is secured to actuating mechanism 20 with screw 61. Extension 62 extends outwardly and is attached to cam follower 65 that rides against cam profile 141 on lower portion 120 of link member 110. Cam profile 141 includes an angled recess portion 142. Upon initial rotation of the link driving member 60, the cam follower 65 engages the angled recess portion 142 imparting lateral movement to link member 110, which in turn moves downwardly extending tab 132 of upper portion 130 of link member 130 into position behind the notch 52 of the plug 50 (shown in FIG. 1 and described in more detail below) to prevent removal of the plug 50. Once the link member 110 has been moved laterally into position to prevent removal of the plug, the link driving member 60 may further rotate along cam profile 141 to move the link driving member into an ON position where the switch 17 (shown in FIG. 2) is at the same time moved into an ON position. Alternately, the cam profile 141 could be such that the link member 110 is moved laterally at the same time the link driving member 60 is rotated through 90 degrees to the ON position.

Link member 110 includes a lower portion 120 and an upper portion 130 linked together by two angled members 112 and 114. Follower holder 77 is secured to the upper housing 12 by screws 101, 103, 105, and 107. The lower portion 120 of link member 110 is positioned between the follower holder 77 and the top of upper housing 12. Lateral movement of link member 110 is allowed by elongated slots 121, 122, 123, and 124 in lower portion 120 that are positioned around screws 101, 103, 105, and 107 used to secure follower holder 77 to housing 12.

Upper portion 130 of link member 110 is positioned between the housing 12 and a plate 94 that is secured to housing 12 with screws 98 and 99 that extend through holes 98*a* and 99*a* in plate 94, through spacers 98*c* and 99*c*, through elongated slots 117 and 116 in upper portion 130 of link member 110, and are secured to threaded holes 98*b* and 99*b* in the housing 12. Elongated slots 117 and 116 on the upper portion 130 of link member 110 are positioned about the screws 98 and 99 and spacers 98*c* and 99*c* to allow for lateral movement of link member 110.

Link blocking member 80 is positioned within plate 94 and is spring biased by spring 90 positioned between the link blocking member 80 and a flange 96 upwardly extending from plate 94. Link blocking member 80 is also positioned within recess 140 of upper portion 130 of link member 110. In the OFF position, link blocking member is in a blocked positioned engaged with notch 118 of upper portion 130 of link member 110. A flange 134 extends upwardly from upper portion 130 of link member 110 and spans recess 140. Flange 134 further includes a downwardly extending tab 132 used to block removal of the plug 50 (shown in FIG. 1) when the switch 17 is in the ON position.

Figure 4:
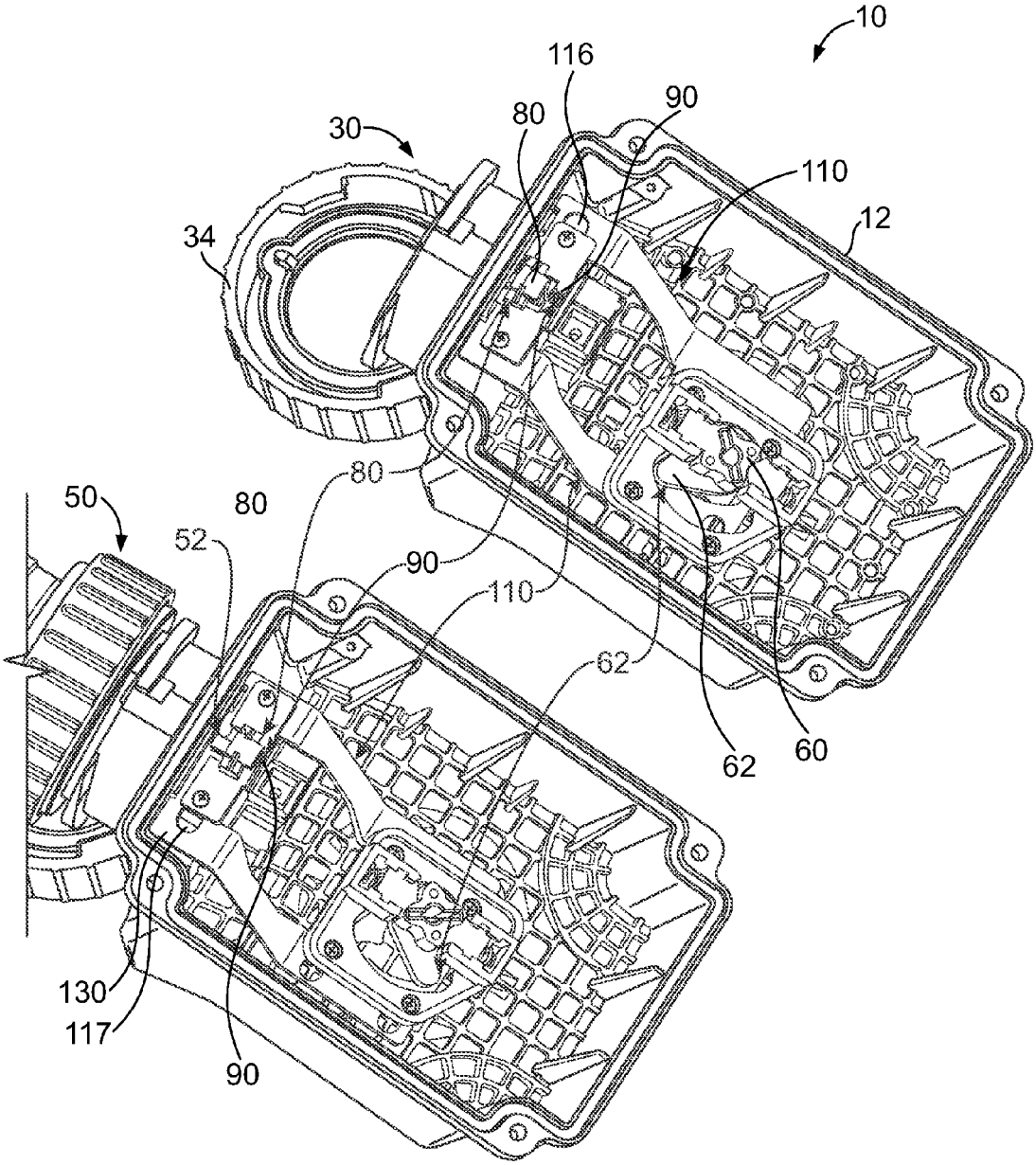
FIG. 4 provides another view of the inside of upper housing 12 shown in FIGS. 2 and 3 showing a switch in an ON and an OFF position.

FIG. 4 provides another view of the inside of upper housing 12 shown in FIGS. 2 and 3 showing a switch in an ON position on the left and in an OFF position on the right. On the right hand side of FIG. 4, link driving member 60 is shown with extension 62 positioned towards the plug receptacle 30. In this case, cover 34 of plug receptacle 30 is open, but no plug is positioned within the plug receptacle. Thus, in this case, the link blocking member 80 is biased by spring 90 into a blocked position. Link member 110 is positioned generally towards the right side of housing 12 as can be seen by exposed elongated slot 116.

In the left side of FIG. 4, a plug 50 has been inserted into the plug receptacle, and notch 52 on the plug has pushed the link blocking member 80 and compressed spring 90 to move the link blocking member 80 into an unblocked position. Link driving member extension 62 has been rotated 90 degrees to move link member 110 laterally towards the left as shown by exposed elongated slot 117 in upper portion 130 of link member 110. With driving member extension 62 in this position with plug 50 positioned in the plug receptacle, the switch is now in the ON position.

Figure 5:
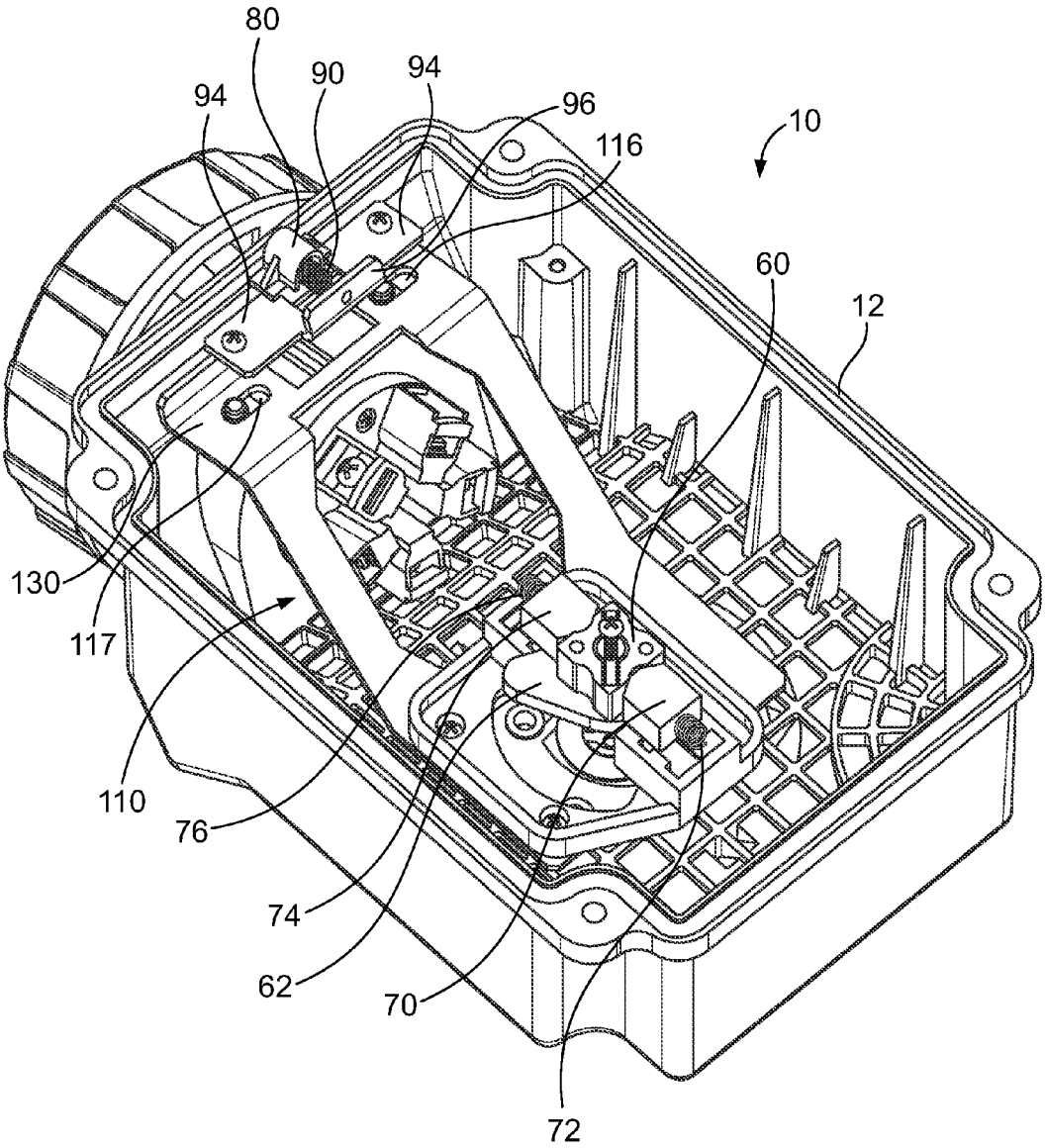
FIG. 5 is a perspective view of the inside of upper housing 12 shown in FIGS. 2-4.

FIG. 5 is a perspective view of the inside of upper housing 12 shown in FIGS. 2-4 with the link driving member 60 in the OFF position. As in the right hand side of FIG. 4, the link member 110 is shown positioned generally to the right as can be seen with reference to elongated slots 116 and 117 in upper portion 130 of link member 110. Followers 70 and 74 are biased by springs 72 and 76 to maintain the link driving member 60 in the OFF position with extension 62 directed towards the plug receptacle. In this OFF position, spring 90 is positioned between flange 96 on plate 94 and link blocking member 80 to bias the link blocking member 80 into a blocked position.

Figure 6:
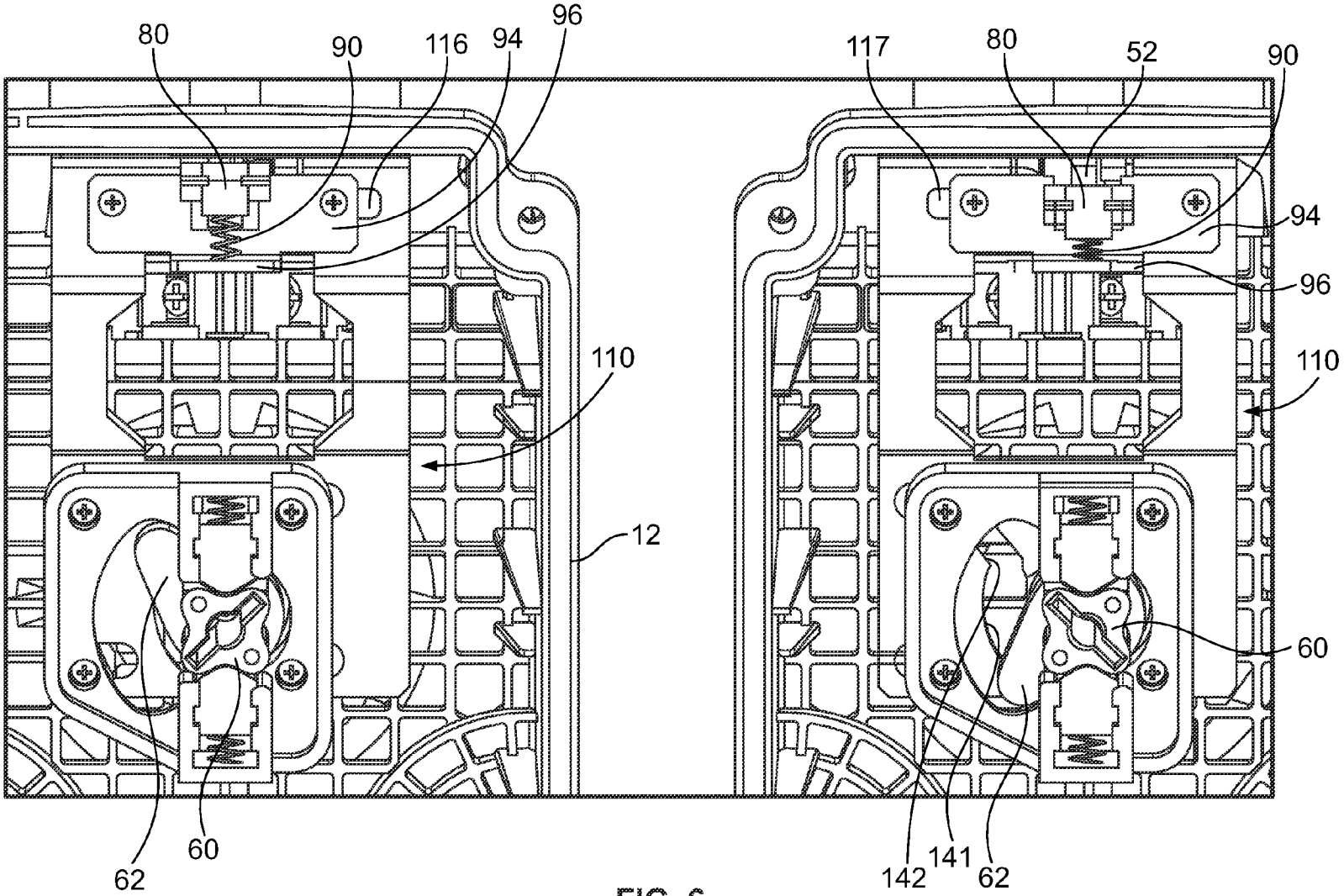
FIG. 6 provides a close up view of the inside of upper housing 12 shown in FIGS. 2-5 showing a switch in an ON position and in an OFF position.

FIG. 6 provides a close up view of the inside of upper housing 12 shown in FIGS. 2-5 showing a switch in an OFF position on the left side and in an ON position on the right side. On the left hand side of FIG. 6, link driving member 60 is shown with extension 62 positioned towards the plug receptacle 30. In this OFF position, the link blocking member 80 is biased into a blocked position by spring 90 positioned between link blocking member 80 and flange 96 extending upwardly from plate 94. Link member 110 is positioned generally towards the right side of housing 12 as can be seen by exposed elongated slot 116.

In the right hand side of FIG. 6, a plug has been inserted into the plug receptacle, and notch 52 on the plug has pushed the link blocking member 80 and compressed spring 90 to move the link blocking member 80 into an unblocked position. Link driving member extension 62 has been rotated along angled recess 142 of cam profile 141 to move link member 110 laterally towards the left as shown by exposed elongated slot 117 in upper portion 130 of link member 110. Link driving member 60 has been further rotated 90 degrees from the OFF position to an ON position. With driving member extension 62 in this position with plug 50 positioned in the plug receptacle, the switch is now in the ON position with notch 52 of the plug moving blocking member 80 into an unblocked position by compressing spring 90 against flange 96 upwardly extending from plate 94.

Figure 7:
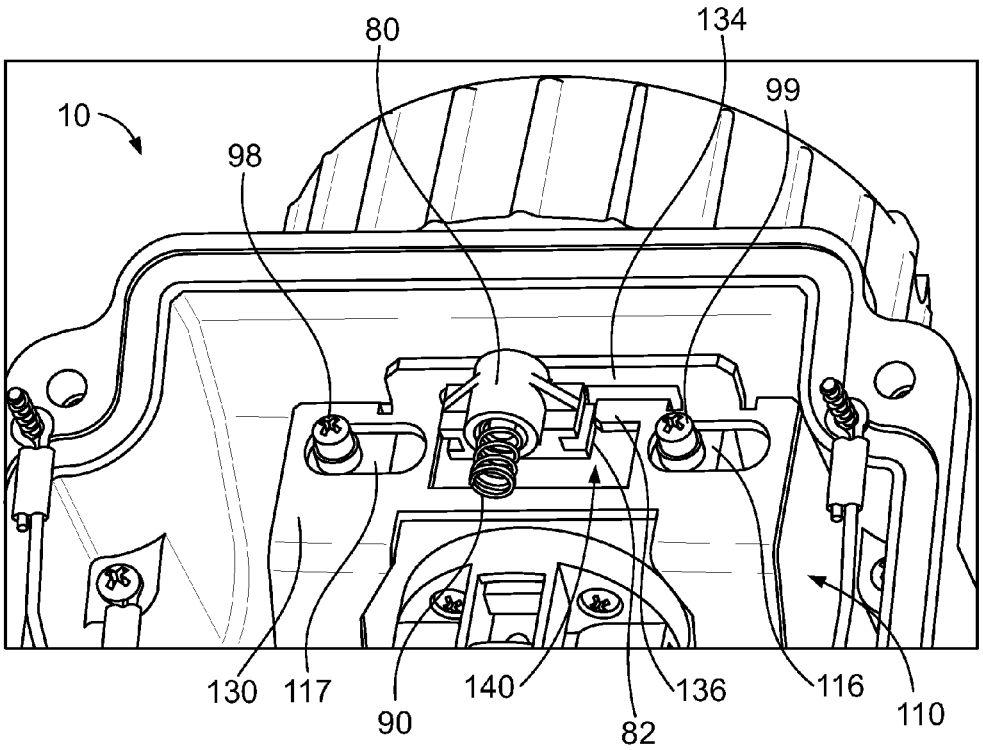
FIG. 7 is a perspective close up view of the inside of upper housing 12 showing link blocking member 80 in a locked position blocking movement of a link member by being positioned against a notch 136 on an upper portion 130 of the link member, where a switch is in the OFF position, according to an example embodiment.

FIG. 7 is a perspective close up view of the inside of upper housing 12 with plate 94 removed showing link blocking member 80 in a locked position blocking movement of link member 110 by being positioned against a notch 136 on an upper portion 130 of the link member 110, when a switch is in the OFF position. In this OFF and locked position, it is not possible to rotate the mechanical actuator 20 (shown in FIGS. 1 and 2) to place the switch into an ON position. With no plug in the plug receptacle, spring 90 biases the link blocking member 80 towards the plug receptacle such that edge 82 of link blocking member 80 abuts notch 136 on upper portion 130 of the link member 110, thereby preventing any lateral movement of the link member 110. In this OFF position, the link member 110 is positioned generally to the right as illustrated by elongated slots 116 and 117 and screws 98 and 99. When in this OFF position, the link blocking member 80 is only partially positioned within recess 140 on upper portion 130 of link member 110.

Figure 8:
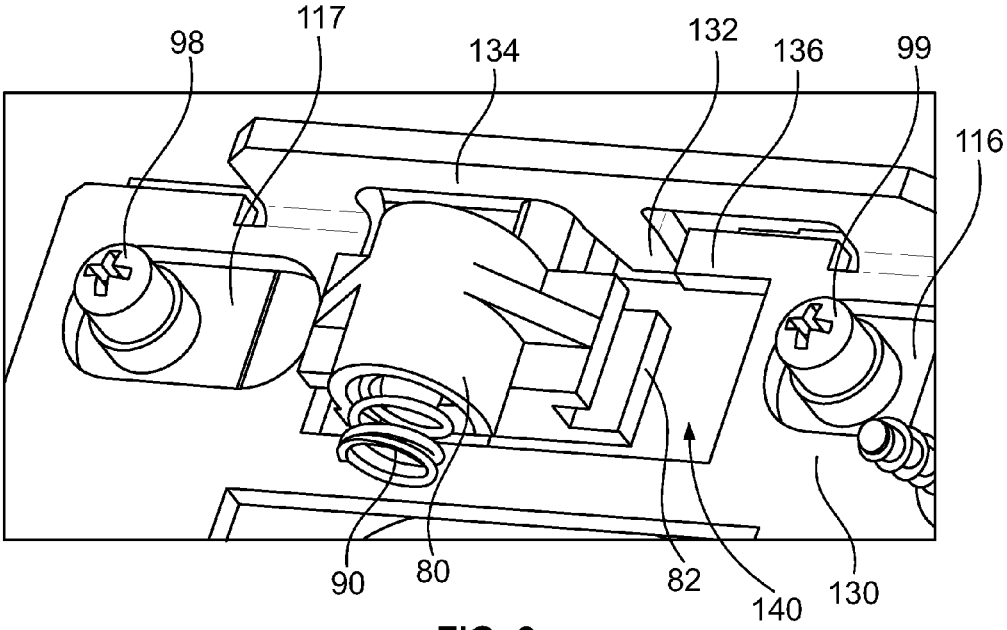
FIG. 8 is a perspective close up view showing link blocking member 80 shown in FIG. 7 moved into a unblocked position by a notch 52 on a plug that has been inserted into the plug receptacle, where link blocking member 80 has been moved into position within recess 140 of upper portion 130 of the link member and out of engagement with notch 136, such that a switch may now be turned to an ON position.

FIG. 8 is a perspective close up view showing link blocking member 80 shown in FIG. 7 moved into a unblocked position by a notch 52 on a plug that has been inserted into the plug receptacle, where link blocking member 80 has been moved to compress spring 90 and moved into position within recess 140 of upper portion 130 of the link member and out of engagement with notch 136, such that a switch may now be turned to an ON position. In this position, the link member 110 has not yet been moved laterally such that notch 52 is blocked from being removed by downwardly extending tab 132, as indicated by the positioning of screws 98 and 99 in elongated slots 116 and 117.

Figure 9:
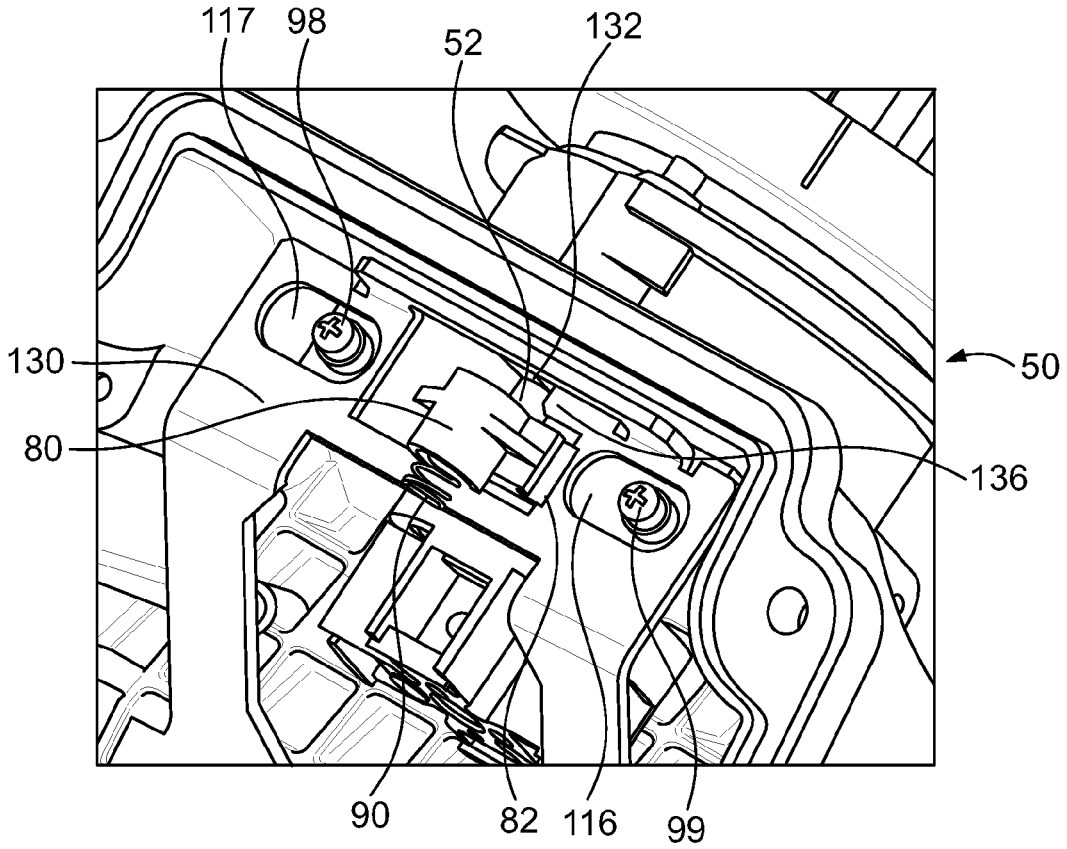
FIG. 9 is a perspective close up view showing link blocking member 80 shown in FIGS. 7 and 8 moved fully into the recess in the upper portion 130 of the link member when the switch is turned to an ON position, wherein a downwardly extending tab 132 on the upper portion 130 of the link member has been moved into position behind the notch 52 on the plug to prevent removal of the plug when the switch is in the ON position.

FIG. 9 is a perspective close up view showing link blocking member 80 shown in FIGS. 7 and 8 moved fully into the recess 140 in the upper portion 130 of the link member 110 when the switch is turned to an ON position. As seen indicated by the relative positioning of screws 98 and 99 within elongated slots 116 and 117, the link member has been laterally moved to the left, wherein downwardly extending tab 132 on the upper portion 130 of the link member 110 has been moved into position behind the notch 52 on the plug to prevent removal of the plug when the switch is in the ON position.

Figure 10:
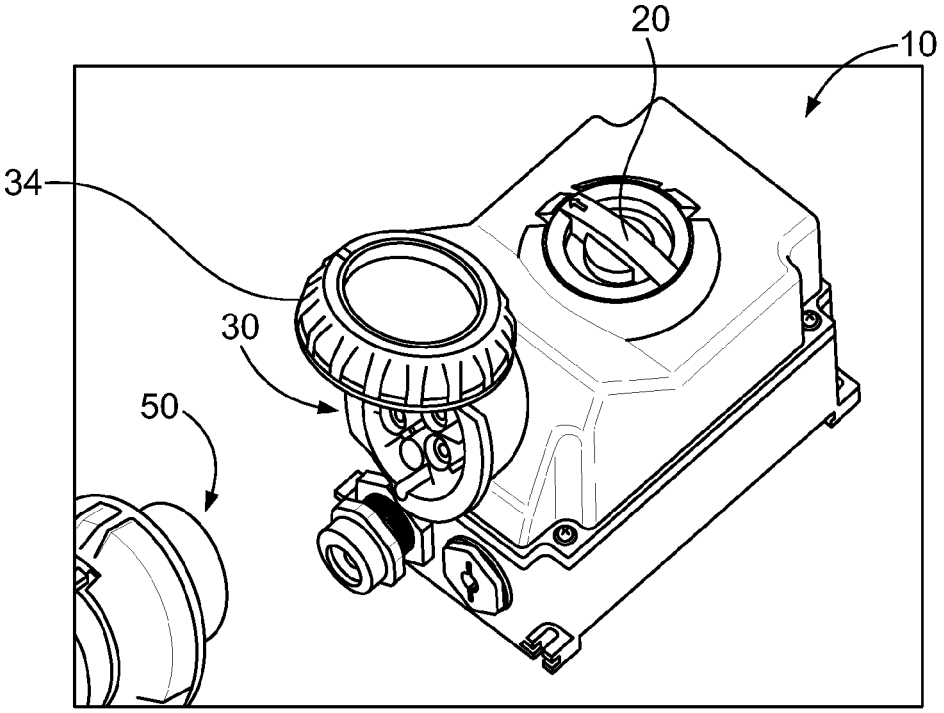
FIG. 10 is a perspective view of plug 50 and plug receptacle housing 10 of electrical plug and receptacle assembly 100 shown in FIG. 1 with receptacle cover 34 opened and just prior to placing the plug 50 into the plug receptacle 30.

FIG. 10 is a perspective view of plug 50 and plug receptacle housing 10 of electrical plug and receptacle assembly 100 shown in FIG. 1 with receptacle cover 34 opened and just prior to placing the plug 50 into the plug receptacle 30. With plug 50 positioned outside of the plug receptacle 30, the actuating mechanism 20 is positioned in the OFF position.

Figure 11:
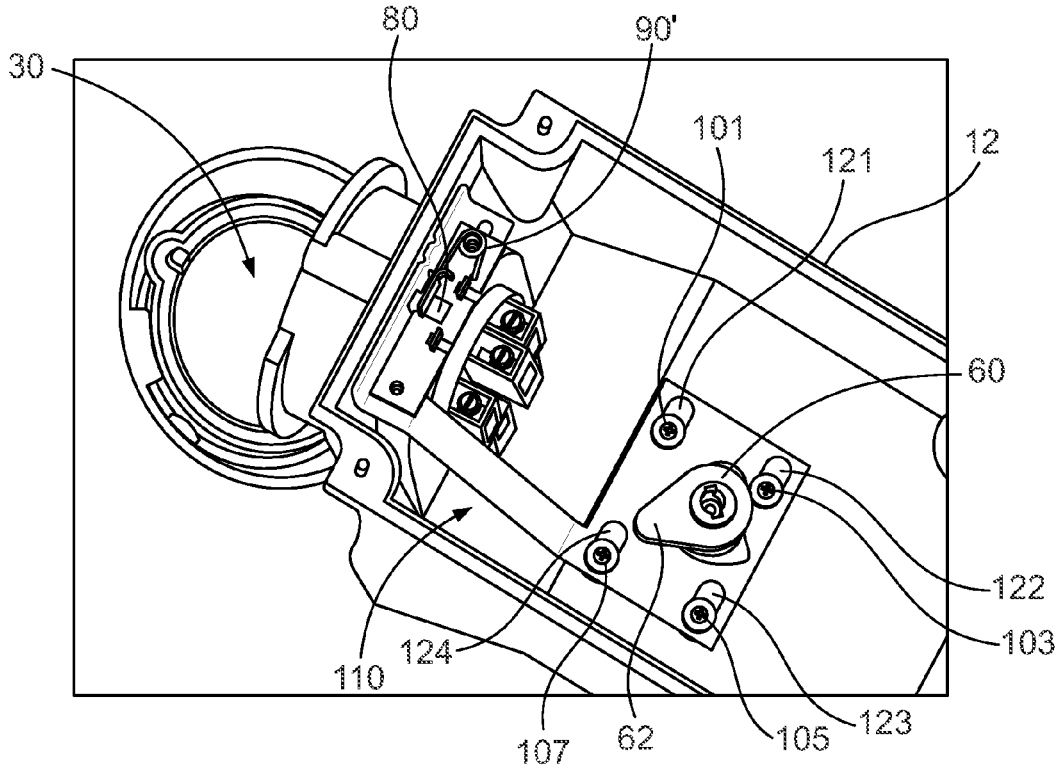
FIG. 11 is a perspective view of the inside of the housing 12 of plug receptacle housing 10 shown in FIG. 10, with no plug positioned in the plug receptacle 30 and with link blocking member 80 in a blocked position with the link driving member 60 in an OFF position.

FIG. 11 is a perspective view of the inside of upper housing 12 of plug receptacle housing 10 shown in FIG. 10 with the lower housing removed and the followers and follower holders removed, with no plug positioned in the plug receptacle 30 and with link blocking member 80 in a blocked position with link driving member 60 in an OFF position where extension 62 is directed towards the plug receptacle 30. In this OFF position, link member 110 is positioned generally to right as indicated by the relative positions of screws 101, 103, 105, and 107 within elongated slots 121, 122, 123, and 124 on lower portion 120 of link member 110. In this embodiment, a torsion spring 90', instead of a compression spring, is used to bias the link blocking member 80 into the blocked position.

Figure 12:
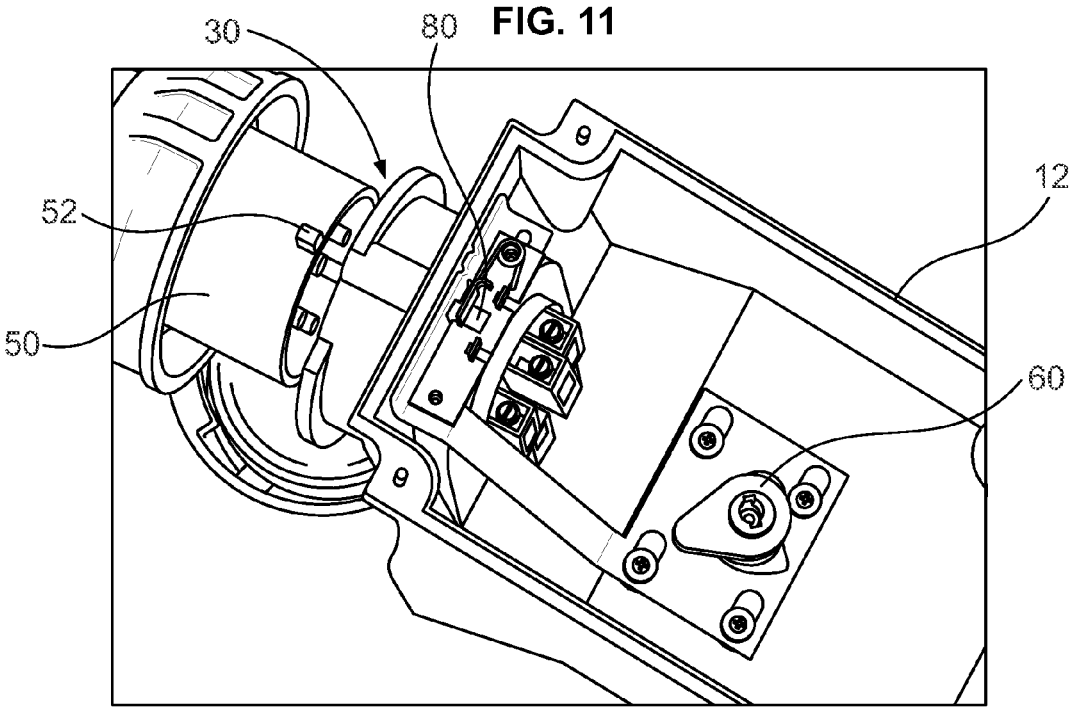
FIG. 12 is a perspective view of the inside of the housing 12 shown in FIG. 11, just prior to placement of plug 50 having notch 52 into the plug receptacle 30 and with link blocking member 80 in a blocked position with the link driving member 60 in an OFF position.

FIG. 12 is a perspective view of the inside of upper housing 12 shown in FIG. 11, just prior to placement of plug 50 having notch 52 into the plug receptacle 30 and with link blocking member 80 in a blocked position with link driving member 60 in an OFF position.

Figure 13:
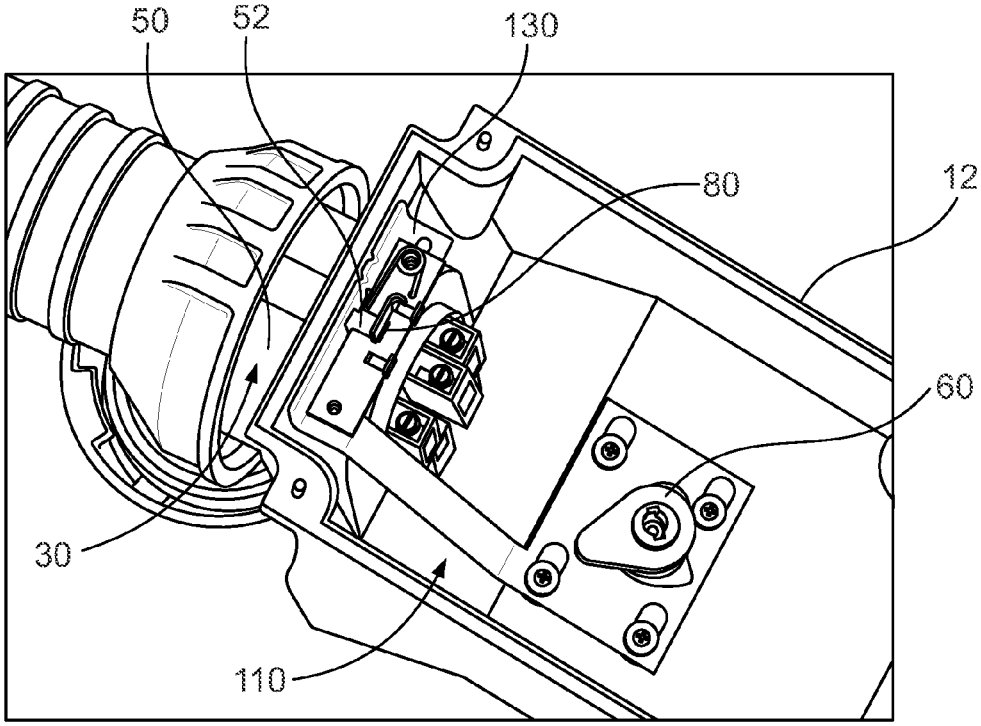
FIG. 13 is a perspective view of the inside of the housing 12 shown in FIGS. 11 and 12, just after plug 50 having notch 52 has been moved into the plug receptacle 30 and with notch 52 moving link blocking member 80 in an unblocked position where a switch actuator may now be operated to move a downwardly extending tab 132 on the upper portion 130 of the link member into a position behind the notch 52 on the plug 50 to prevent removal of the plug 50 from the plug receptacle 30.

FIG. 13 is a perspective view of the inside of the housing 12 shown in FIGS. 11 and 12, just after plug 50 having notch 52 has been moved into the plug receptacle 30 and with notch 52 moving link blocking member 80 to an unblocked position where a switch actuator may now be operated to rotate link driving member 60 to manipulate the switch to an ON position, by laterally moving link member 110 to move a downwardly extending tab 132 on the upper portion 130 of the link member 110 into a position behind the notch 52 on the plug 50 (as shown in FIG. 9) to prevent removal of the plug 50 from the plug receptacle 30 when in this ON position.

Figure 14:
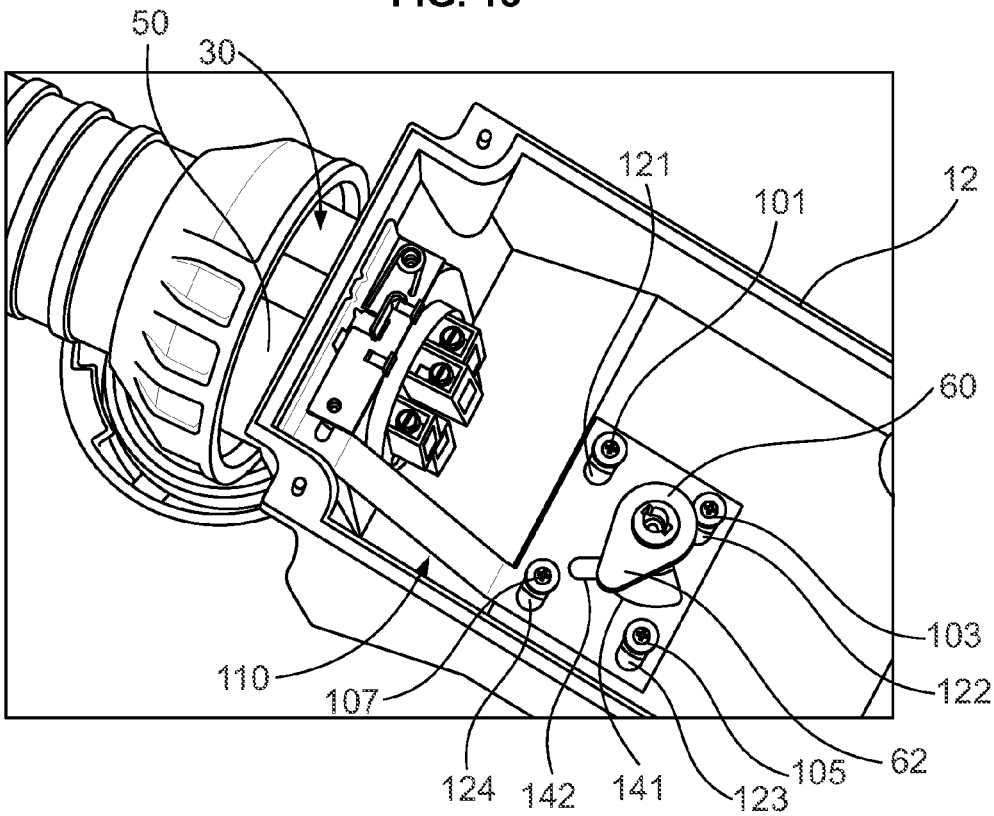
FIG. 14 is a perspective view of the inside of the housing 12 shown in FIG. 13, after extension 62 of link driving member 60 has moved along angled recess 142 of the cam profile 141 on the lower portion 120 of link member 110 to move the link member 110 to the left where the downwardly extending tab 132 on the upper portion 130 of the link member 110 has also been moved into a position behind the notch 52 on the plug 50 (as shown in FIG. 9) to prevent removal of the plug 50 from the plug receptacle 30.

FIG. 14 is a perspective view of the inside of the housing 12 shown in FIG. 13, after extension 62 of link driving member 60 has moved along angled recess 142 of the cam profile 141 on the lower portion 120 of link member 110 to move the link member to the left as indicated by the relative positions of screws 101, 103, 105, and 107 within elongated slots 121, 122, 123, and 124 in the lower portion 120 of link member 110. When the link member 110 is moved laterally to the left in this fashion, the downwardly extending tab 132 on the upper portion 130 of the link member 110 has also been moved into a position behind the notch 52 on the plug 50 (as shown in FIG. 9) to prevent removal of the plug 50 from the plug receptacle 30.

Figure 15:
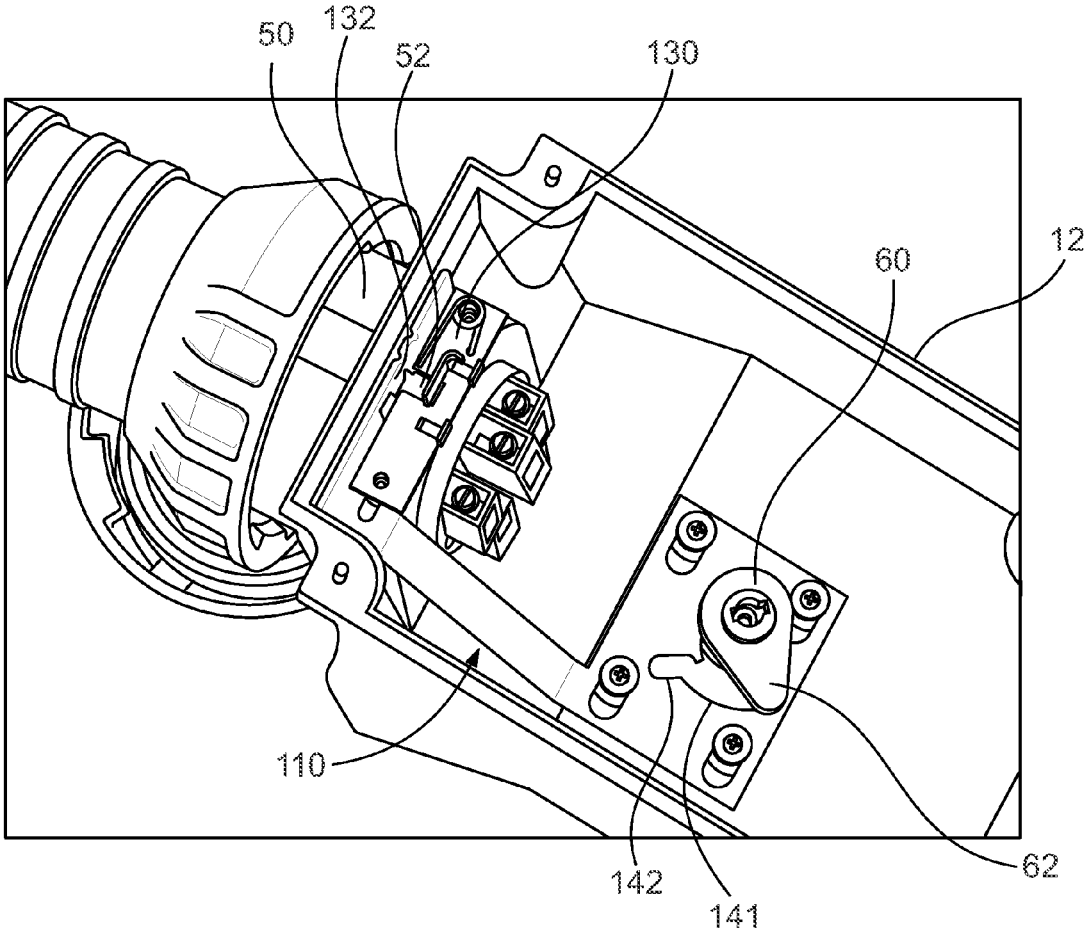
FIG. 15 is a is a perspective view of the inside of the housing 12 shown in FIG. 14, after the link driving member 60 has been fully rotated into an ON position.

FIG. 15 is a is a perspective view of the inside of the housing 12 shown in FIG. 14, after the link driving member 60 has been fully rotated 90 degrees into an ON position. In this ON position, the downwardly extending tab 132 on the upper portion 130 of the link member 110 remains positioned behind the notch 52 on plug 50 (as shown in FIG. 9) to prevent removal of the plug 50 from the plug receptacle when the switch is in the ON position.

Figure 16:
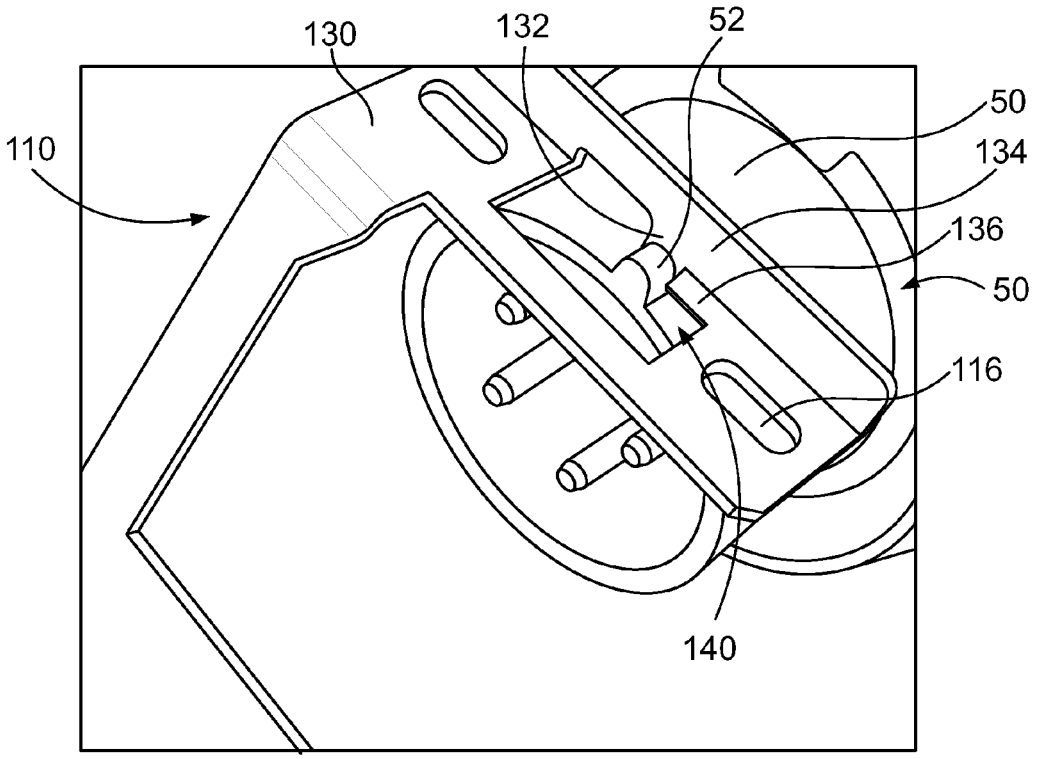
FIG. 16 is a perspective view of the downwardly extending tab 132 of upper portion 130 of the link member positioned behind the notch 52 of plug 30 when the switch is in the ON position.

FIG. 16 shows the interaction between the downwardly extending tab 132 of upper portion 130 of the link member with the notch 52 of plug 50 when switch is in the ON position. In particular, notch 52 of plug 50 extends into recess 140 adjacent notch 136 in the upper portion 130 of link member 110. The downwardly extending tab 132 attached to flange 134 of upper portion 130 has been moved into position behind the notch 52 to prevent the plug from being removed with the switch is in the ON position.

Figure 17:
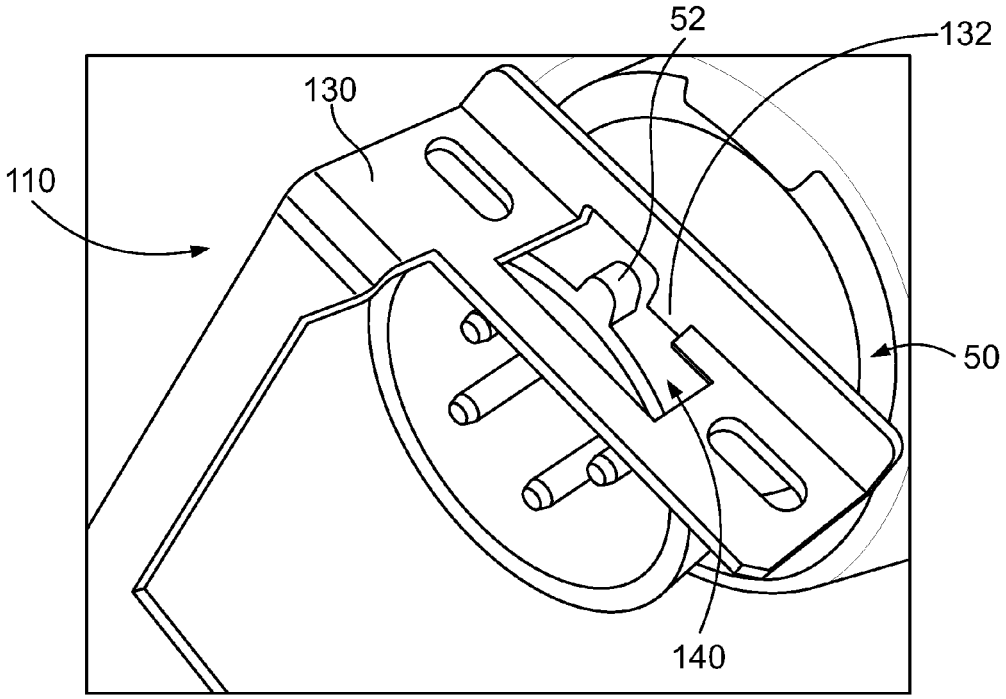
FIG. 17 is a perspective view of the downwardly extending tab 132 of upper portion 130 of the link member prior to positioning behind the notch 52 of plug 50 when the switch is in the OFF position.

FIG. 17 shows the interaction between the downwardly extending tab 132 of upper portion 130 of link member 110 and notch 52 of plug 50 when plug 50 has been inserted into the plug receptacle, but prior to the switch being moved into ON position. In this case, the notch 52 extends past downwardly extending tab 132 into recess 140 of upper portion 130 of link member 110.

It will be appreciated the above embodiments are illustrative and that the components could take different forms or geometries. For example, while actuating member 20 on the exterior of plug receptacle housing 10 (shown in FIG. 1) is shown as a rotating member, it could also operate using linear movement to laterally move the link member 110 from on OFF position to an ON position. In addition, the link member 110 could be made of various geometries, where the link member has a blocking portion that extends behind the notch 52 of the plug when the switch is in the ON position to prevent removal of the plug when the switch is in the ON position. The notch blocking member is shown as a downwardly extending flange but could also take the form of an upwardly extending flange, side mounted flange, or other member that may be moved into position behind the notch 52 upon movement of the link member 110 and perform a blocking function. The link member 110 may have a portion in communication with the link driving member 60 that imparts lateral movement to the link member 110 and a notch blocking portion that blocks the notch 52 of plug 50 preventing removal of the plug 50 when the switch is in an ON position.

Furthermore, rotational or linear movement of the actuating mechanism 20 may also utilize other ways of laterally moving the link member 110 in addition to using a cam profile on a lower portion of the link member that cooperates with a cam member on an extension of the link driving member. For example, a rack and pinion assembly or gear assembly could be used to impart lateral movement to the link member 110. Other known methods of translating rotational motion into linear motion known to those of ordinary skill in the art could also be used. Moreover, the link member itself could be spring-biased into an OFF position, and moved into an ON position by movement of a link driving member.

Example embodiments have been described above. Those skilled in the art will understand that changes and modifications may be made to the described embodiments without departing from the true scope and spirit of the present invention, which is defined by the claims.

We claim:

1. An electrical plug and receptacle assembly comprising:

a housing having an internal cavity;

a switch positioned within the internal cavity of the housing;

an actuating mechanism positioned on an exterior of the housing and adapted for manipulating the switch to an ON position and to an OFF position;

a receptacle attached to the housing, the receptacle adapted to receive a plug;

a plug having a notch positioned on an outer surface of the plug, the notch having a front side and a rear side;

a link driving member positioned within the housing and attached to the actuating mechanism;

a link member positioned within the housing, the link member adapted to move laterally when the switch is turned from the OFF position to the ON position;

a link blocking member positioned within the housing that is movable from a first blocking position where lateral movement of the link member is blocked to a second unblocked position where lateral movement of the link member is allowed;

wherein when the plug is fully inserted into the receptacle, the front side of the notch on the plug contacts the link blocking member and causes the link blocking member to move into the second unblocked position;

wherein when the link blocking member is in the second unblocked position with the plug fully inserted into the receptacle, the actuating mechanism is movable to have the link driving member laterally move the link member and turn the switch from the OFF position to the ON position.

2. The electrical plug and receptacle assembly of claim 1, wherein upon lateral movement of the link member when the switch is turned to the ON position, a notch blocking member is moved into position behind the rear side of the notch on the plug that prevents removal of the plug when the switch is turned to the ON position.

3. The electrical plug and receptacle assembly of claim 1, wherein the link driving member is a rotatable member.

4. The electrical plug and receptacle assembly of claim 3, wherein the link driving member is a cam and a lower portion of the link member includes a cam profile.

5. The electrical plug and receptacle assembly of claim 4, wherein the cam profile includes an angled recess such that upon initial movement of the actuating mechanism towards the ON position, the link member is caused to move laterally to position the notch blocking member on the link member into position behind the rear side of the notch on the plug before the switch is energized in the ON position.

6. The electrical plug and receptacle assembly of claim 1, wherein lateral movement of the link member is allowed by lateral slots positioned in a lower portion of the link member and an upper portion of the link member.

7. The electrical plug and receptacle assembly of claim 1, wherein the link blocking member is positioned within an upper portion of the link member, and the link blocking member is moved into a recess in the upper portion of the link member when the link blocking member is moved into the second unblocked position.

8. The electrical plug and receptacle assembly of claim 7, wherein the link blocking member is also positioned within a plate secured to the housing.

9. The electrical plug and receptacle assembly of claim 1, wherein the link blocking member is spring biased into the first blocked position.

10. The electrical plug and receptacle assembly of claim 8, wherein the link blocking member is spring biased into the first blocked position by a spring positioned between the link blocking member and a flange upwardly extending from the plate.

11. The electrical plug and receptacle assembly of claim 2, wherein the notch blocking member comprises a tab extending from an upper portion of the link member.

12. The electrical plug and receptacle assembly of claim 3, wherein the link driving member includes indexing surfaces adapted to conform to surfaces on one or more spring loaded followers that prevent the link driving member to be positioned in between an ON position or an OFF position.

13. The electrical plug and receptacle assembly of claim 1, wherein the link member includes a lower portion positioned beneath the link driving member and an upper portion positioned adjacent the receptacle.

14. The electrical plug and receptacle assembly of claim 13, wherein the upper portion of the link member and the lower portion of the link member are connected by one or more angled arms.

15. An electrical plug and receptacle assembly comprising:

a housing having an internal cavity;

a switch positioned within the internal cavity of the housing;

an actuating mechanism positioned on an exterior of the housing and adapted for manipulating the switch to an ON position and to an OFF position;

a receptacle attached to the housing, the receptacle adapted to receive a plug;

means for preventing movement of the actuating mechanism to manipulate the switch to an ON position when the plug is not positioned in the receptacle;

means for preventing removal of the plug from the receptacle when the switch is in the ON position;

a link driving member positioned within the housing and attached to the actuating mechanism;

a link member positioned within the housing, the link member adapted to move laterally when the switch is turned from the OFF position to the ON position;

a link blocking member positioned within the housing that is movable from a first blocking position where lateral movement of the link member is blocked to a second unblocked position where lateral movement of the link member is allowed;

wherein when the plug is fully inserted into the receptacle, a front side of a notch on the plug contacts the link blocking member and causes the link blocking member to move into the second unblocked position; and wherein when the link blocking member is in the second unblocked position with the plug fully inserted into the receptacle, the actuating mechanism is movable to have the link driving member laterally move the link member and turn the switch from the OFF position to the ON position.

16. The electrical plug and receptacle assembly of claim 15, wherein the plug includes a notch positioned on an outer surface of the plug, the notch having a front side and a rear side;

wherein when the switch is moved to the ON position, a notch blocking portion is moved into position adjacent the rear side of the notch on the plug to prevent removal of the plug when the switch is in the ON position.

17. The electrical plug and receptacle assembly of claim 15, wherein upon lateral movement of the link member when the switch is turned to the ON position, a notch blocking member is moved into position behind a rear side of the notch on the plug that prevents removal of the plug when the switch is turned to the ON position.

18. The electrical plug and receptacle assembly of claim 15, wherein the link driving member is a rotatable member and comprises a cam and a lower portion of the link member includes a cam profile.

19. The electrical plug and receptacle assembly of claim 18, wherein the cam profile includes an angled recess such that upon initial movement of the actuating mechanism towards the ON position, the link member is caused to move laterally to position a notch blocking member on the link member into position behind a rear side of the notch on the plug before the switch is energized in the ON position.

20. The electrical plug and receptacle assembly of claim 15, wherein the link blocking member is positioned within an upper portion of the link member, and the link blocking member is moved into a recess in the upper portion of the link member when the link blocking member is moved into the second unblocked position.

21. The electrical plug and receptacle assembly of claim 15, wherein the link blocking member is also positioned within a plate secured to the housing.

22. The electrical plug and receptacle assembly of claim 15, wherein the link blocking member is spring biased into the first blocked position.

23. The electrical plug and receptacle assembly of claim 21, wherein the link blocking member is spring biased into the first blocked position by a spring positioned between the link blocking member and a flange upwardly extending from the plate.

24. The electrical plug and receptacle assembly of claim 16, wherein the notch blocking member comprises a tab extending from an upper portion of the link member.

25. The electrical plug and receptacle assembly of claim 16, wherein lateral movement of the notch blocking member is effected by a gear train.

26. The electrical plug and receptacle assembly of claim 18, wherein the link driving member includes indexing surfaces adapted to conform to surfaces on one or more spring loaded followers that prevent the link driving member to be positioned in between an ON position or an OFF position.

27. A method of providing an interlocking mechanism for an electrical plug and receptacle, comprising the steps of:

providing an electrical plug and receptacle assembly having a housing with an internal cavity, a switch positioned within the internal cavity of the housing, an actuating mechanism positioned on an exterior of the housing and adapted for manipulating the switch to an ON position and to an OFF position, a receptacle attached to the housing, the receptacle adapted to receive a plug, the plug having a notch positioned on an outer surface of the plug, the notch having a front side and a rear side, a link driving member positioned within the housing and attached to the actuating mechanism, a link member positioned within the housing, the link member adapted to move laterally when the switch is turned from the OFF position to the ON position, a link blocking member positioned within the housing that is movable from a first blocking position where lateral movement of the link member is blocked to a second unblocked position where lateral movement of the link member is allowed;

inserting the plug into the receptacle to cause the front side of the notch on the plug to contact the link blocking member and move the link blocking member into the second unblocked position;

moving the actuating mechanism to cause the link driving member to laterally move the link member and move a notch blocking member into position behind the rear side of the notch on the plug; and further moving the actuating mechanism to turn the switch from the OFF position to the ON position, wherein the notch blocking member prevents removal of the plug when the switch is turned to the ON position.

28. The method of claim 27, wherein the notch blocking member is a flange positioned on an upper portion of the link member.

29. The method of claim 27, wherein the link driving member comprises a cam and lateral movement of the link member is caused by the cam moving through an angled surface of a cam profile positioned on a lower portion of the link member.

* * * * *